US012329213B2

(12) United States Patent
Weirtz et al.

(10) Patent No.: US 12,329,213 B2
(45) Date of Patent: Jun. 17, 2025

(54) POSTERIOR-ENHANCING SHAPEWEAR GARMENT

(71) Applicant: Spanx, LLC, Atlanta, GA (US)

(72) Inventors: Natalie Weirtz, Atlanta, GA (US); Angelica Melendez, Atlanta, GA (US); Elena Novosiolova, Atlanta, GA (US)

(73) Assignee: Spanx, LLC, Atlanta, GA (US)

( * ) Notice: Subject to any disclaimer, the term of this patent is extended or adjusted under 35 U.S.C. 154(b) by 831 days.

(21) Appl. No.: 16/854,240

(22) Filed: Apr. 21, 2020

(65) Prior Publication Data

US 2020/0337387 A1 Oct. 29, 2020

Related U.S. Application Data

(60) Provisional application No. 62/840,023, filed on Apr. 29, 2019.

(51) Int. Cl.
*A41C 1/00* (2006.01)
*A41B 9/08* (2006.01)

(52) U.S. Cl.
CPC ..... *A41C 1/003* (2013.01); *A41B 9/08* (2013.01); *A41B 2300/20* (2013.01); *A41B 2400/38* (2013.01)

(58) Field of Classification Search
CPC ..... A41C 1/003; A41B 9/08; A41B 2400/38; A41D 27/20; A41D 27/26; A41D 7/00
See application file for complete search history.

(56) References Cited

U.S. PATENT DOCUMENTS 3,295,530 A * 1/1967 Mayer ..... A41C 1/003 450/98
4,955,088 A * 9/1990 Terjesen ..... A41B 9/02 2/403
5,649,328 A 7/1997 Martin
5,708,986 A 1/1998 Belardinelli
5,749,101 A * 5/1998 Breindel ..... A41D 13/0575 2/403
5,842,232 A * 12/1998 Parrish ..... A41D 13/0575 450/97
6,174,217 B1 1/2001 Judson
6,182,297 B1 * 2/2001 Duren ..... A41D 13/0575 450/99
6,543,062 B1 4/2003 Amsel et al.
7,081,036 B1 7/2006 Howard et al.
(Continued)

FOREIGN PATENT DOCUMENTS

WO 2009/025526 2/2009

*Primary Examiner* — Khoa D Huynh
*Assistant Examiner* — Uyen T Nguyen
(74) *Attorney, Agent, or Firm* — Meunier Carlin & Curfman LLC

(57) ABSTRACT

Shapewear can be used to enhance the appearance of a wearer's buttocks. Typical buttock-enhancing garments include construction that is visible from the exterior and do not provide a natural shape. The garment disclosed herein has an exterior smoothing layer covering an interior construction. The interior construction includes an inner pocket layer and an outer pocket layer attached to an inner garment layer, thus suspending the pockets in the interior of the garment. Pads can be placed in the pockets. The pads and the interior pocket construction provides natural shape to the wearer without compression or bulk.

20 Claims, 6 Drawing Sheets

(56) References Cited

U.S. PATENT DOCUMENTS

| | | | | |
|---|---|---|---|---|
| 7,089,601 | B2 | 8/2006 | Chen | |
| 7,260,961 | B1 | 8/2007 | Kennedy | |
| 7,704,120 | B2 | 4/2010 | Chen et al. | |
| 7,950,069 | B2 | 5/2011 | Lee | |
| 8,141,176 | B2 * | 3/2012 | Lee | A41C 1/003 2/227 |
| D661,056 | S | 6/2012 | Cho | |
| 8,784,347 | B1 | 7/2014 | Smith | |
| 8,966,668 | B2 | 3/2015 | Sutton | |
| 9,572,379 | B2 | 2/2017 | Jones | |
| 9,775,386 | B2 | 10/2017 | Forsythe | |
| 9,901,124 | B2 | 2/2018 | James | |
| 10,021,921 | B2 | 7/2018 | James | |
| 10,058,131 | B2 | 8/2018 | Solano et al. | |
| 10,986,877 | B2 * | 4/2021 | Kimel | A41B 9/023 |
| 2008/0271225 | A1 | 11/2008 | Chen et al. | |
| 2009/0031469 | A1 | 2/2009 | Christensen et al. | |
| 2010/0064409 | A1 * | 3/2010 | Buckley | A41D 1/06 2/400 |
| 2012/0216337 | A1 | 8/2012 | Nelson | |
| 2015/0075538 | A1 | 3/2015 | Samuel | |
| 2015/0128331 | A1 * | 5/2015 | Grosse | A41D 31/185 2/400 |
| 2016/0050986 | A1 | 2/2016 | Leandry Meléndez et al. | |
| 2016/0120248 | A1 * | 5/2016 | Oliver | A41B 9/06 2/243.1 |
| 2016/0255889 | A1 * | 9/2016 | Szcepanowski | A41D 27/26 |
| 2017/0258144 | A1 | 9/2017 | Bardini | |
| 2017/0318864 | A1 * | 11/2017 | Carroll | A41B 9/04 |
| 2017/0354187 | A1 | 12/2017 | Bartlett | |
| 2017/0367414 | A1 | 12/2017 | Cano | |
| 2018/0192718 | A1 | 7/2018 | Jones | |

* cited by examiner

POSTERIOR-ENHANCING SHAPEWEAR GARMENT

RELATED APPLICATIONS

This application claims the benefit of U.S. Provisional Application No. 62/840,023, filed Apr. 29, 2019, which is incorporated by reference in its entirety for all purposes.

BACKGROUND

Lower-body shapewear garments can enhance the appearance of a wearer's buttocks. It is desirable for shapewear garments to not be seen when worn under clothing. However, buttock-enhancing garments often do not provide a natural-looking shape to the body due to compression, bulk, or visible construction. Garments used for enhancing the appearance of buttocks often use seaming, pads, or sling constructions. These constructions are often visible on the exterior of the garment, and they are as a result also visible when worn under clothing. Pads may not have a natural shape, or it may be obvious that the wearer's garments include pads. Additionally, features such as sling constructions may add bulk and compress the body.

SUMMARY

A garment is disclosed herein that addresses the aforementioned shortcomings in the field. The garment includes an outer garment layer, an inner garment layer, an outer pocket layer, and a waistband. The outer garment layer covers the inner construction of the garment. The outer pocket layer and the inner pocket layer are positioned to cover the buttocks area of the wearer. The outer pocket layer and the inner pocket layer are attached to the inner garment layer at a pocket perimeter edge, such that the outer pocket layer is suspended between the inner pocket layer and the outer garment layer. The outer pocket layer is attached to the waistband at a top outer pocket edge. The outer pocket layer and a top inner pocket edge of the inner pocket layer define an upper pocket opening. A center seam extends downward from the waistband through the outer pocket layer and inner pocket layer, separating the outer pocket layer and inner pocket layer into a right pocket and a left pocket. The right pocket can hold a right buttock pad, and the left pocket can hold a left buttock pad. The right and left buttock pads can be placed into or removed from the right and left pockets through the upper pocket opening.

In some embodiments, the outer pocket layer is mesh. In some embodiments, the inner pocket layer is mesh. In some embodiments, the waistband is attached to the outer garment layer, the inner garment layer, and the outer pocket layer, and is not visible from an exterior surface of the garment. In some embodiments, the outer garment layer covers the waistband. In some embodiments, the waistband has an upper edge and a lower edge. The outer garment layer is attached to the upper edge of the waistband and extends over an outer surface of the waistband. In some embodiments, the inner garment layer and the outer pocket layer are attached to the lower edge of the waistband. In some embodiments, the inner pocket layer is not attached to the waistband. In some embodiments, the center seam that extends downward from the waistband through the outer pocket layer and inner pocket layer is gathered.

In some embodiments, the outer garment layer and the inner garment layer are formed continuously from the same piece of fabric. In some embodiments, the outer garment layer and the inner garment layer define a right leg opening and a left leg opening. The outer garment layer and the inner garment layer can be connected at a fold along the right and left leg openings. In some embodiments, the outer garment layer further includes an outer garment seam extending downward from the waistband along a back side of the outer garment layer.

In some embodiments, the inner garment layer includes an inner garment edge along the pocket perimeter edge. The outer pocket layer and the inner pocket layer are attached to the inner garment layer at the pocket perimeter edge such that the outer pocket layer is directly adjacent the outer garment layer. In some embodiments, the inner pocket layer and the outer pocket layer are attached to the inner garment layer by a perimeter seam. The seam can be a U-shaped seam that extends downward from the waistband and curves under the buttocks.

In some embodiments, the garment includes a crotch panel in the crotch area of the garment. In some embodiments, the crotch panel is attached to the outer garment layer, the inner garment layer, the outer pocket layer, and the inner pocket layer by a seam. In some embodiments, the garment includes a crotch area, a right leg portion, and a left leg portion. The right leg portion and left leg portion extend from the crotch area.

In some embodiments, the right and left buttock pads are oval-shaped, having two longer sides and two shorter sides. In some embodiments, the oval-shaped pads are not symmetrical, and one of the longer sides of each pad is a less curved side. The pads are placed in the pockets so that the less curved side is adjacent the center seam. In some embodiments, the buttock pads are thinner at the edges than at the center of the pads. In some embodiments, the garment includes a first configuration, in which the right buttock pad are removed from the garment. In a second configuration, the right buttock pad and the left buttock pad are placed into the right and left pockets such that the central, less curved side of each pad is adjacent the center seam.

Also disclosed herein is a method of making a buttocks-enhancing shapewear garment. Methods of making the garment can include the steps of cutting an outer garment layer and an inner garment layer from a garment fabric, cutting an outer pocket layer and an inner pocket layer from a pocket fabric, and forming a right buttock pad and a left buttock pad. The outer pocket layer and the inner pocket layer are attached to the inner garment layer at a pocket perimeter edge, such that the outer pocket layer is suspended between the inner pocket layer and the outer garment layer. The outer garment layer, the inner garment layer, and the outer pocket layer are attached to a waistband. A center seam is sewn from the waistband through the outer pocket layer and the inner pocket layer, separating the outer pocket layer and inner pocket layer into a right pocket and a left pocket. In some embodiments, the right buttock pad is placed into the right pocket and the left buttock pad is placed into the left pocket.

In some embodiments, the outer garment layer and the inner garment layer are cut continuously from the garment fabric. In some embodiments, the center seam extending from the waistband through the outer pocket layer and the inner pocket layer is gathered. In some embodiments, an outer garment seam is sewn extending downward from the waistband along a back side of the outer garment layer. In some embodiments, the inner garment layer has an inner garment edge. The outer pocket layer and inner pocket layer are attached to the inner garment layer at the inner garment edge such that the outer pocket layer is directly adjacent the outer garment layer. In some embodiments, a crotch panel is attached to the outer garment layer, the inner garment layer, the outer pocket layer, and the inner pocket layer.

DETAILED DESCRIPTION

Shapewear garments can be used to alter or improve the appearance of a wearer's buttocks. Buttocks-enhancing shapewear garments can use pads, seaming, and sling constructions to provide additional shape to the wearer. These features are often visible on the exterior of the garment and are therefore also visible under clothing. The shapewear garments disclosed herein provide enhanced appearance to the buttocks but do not have construction that is visible under clothing. The garments use pads suspended in pockets to enhance the appearance of the buttocks. By sewing the pocket into the interior layers of the garment, the pockets and pads are concealed, allowing the garment to maintain a natural shape when worn on the body. A hidden waistband construction provides an anchor point for the garment and helps the garment stay in place.

A garment is described herein that includes an outer garment layer and an inner garment layer. An inner pocket layer and an outer pocket layer are attached to the inner garment layer. The outer pocket layer and inner pocket layer define pockets having upper pocket openings that are configured to hold buttocks pads. The outer garment layer covers the inner garment layer and the outer and inner pocket layers such that the inner garment layer and the outer and inner pocket layers are not visible from the outside of the garment. When the pads are placed in the pockets, the pads are not visible from the outside of the garment.

As used herein, the words "inferior" and "superior" are anatomical terms used to describe the position relative to the wearer's head. "Inferior" is farther from the head, and "superior" is closer to the head. For example, if a first point is inferiorly located in relation to a second point, the first point is farther from the wearer's head than the second point when the garment is being worn as intended. The term "beneath" indicates an inferior position. The term "above" indicates a superior position.

As used herein, the words "medial" and "lateral" are anatomical terms used to describe the position relative to the wearer's sides. "Lateral" is closer to the sides, and "medial" is farther from the sides (closer to the wearer's vertical center line).

As used herein, "fixedly attached" is defined as attached via sewing, bonding, or any other type of attachment that secures two edges in a permanent fashion. Seamlessly attached is defined as continuously formed as one stretch of fabric. Seamless attachment can be achieved by knitting two or more portions, regions, or panels of the garment together as one piece of fabric, such that there is no seam joining the portions. This can be achieved by using a seamless knitting machine, a hosiery machine, or other knitting machine. Seamless attachment can also be done by continuously forming two or more portions or panels as one stretch of woven or non-woven fabric.

Figure 1:
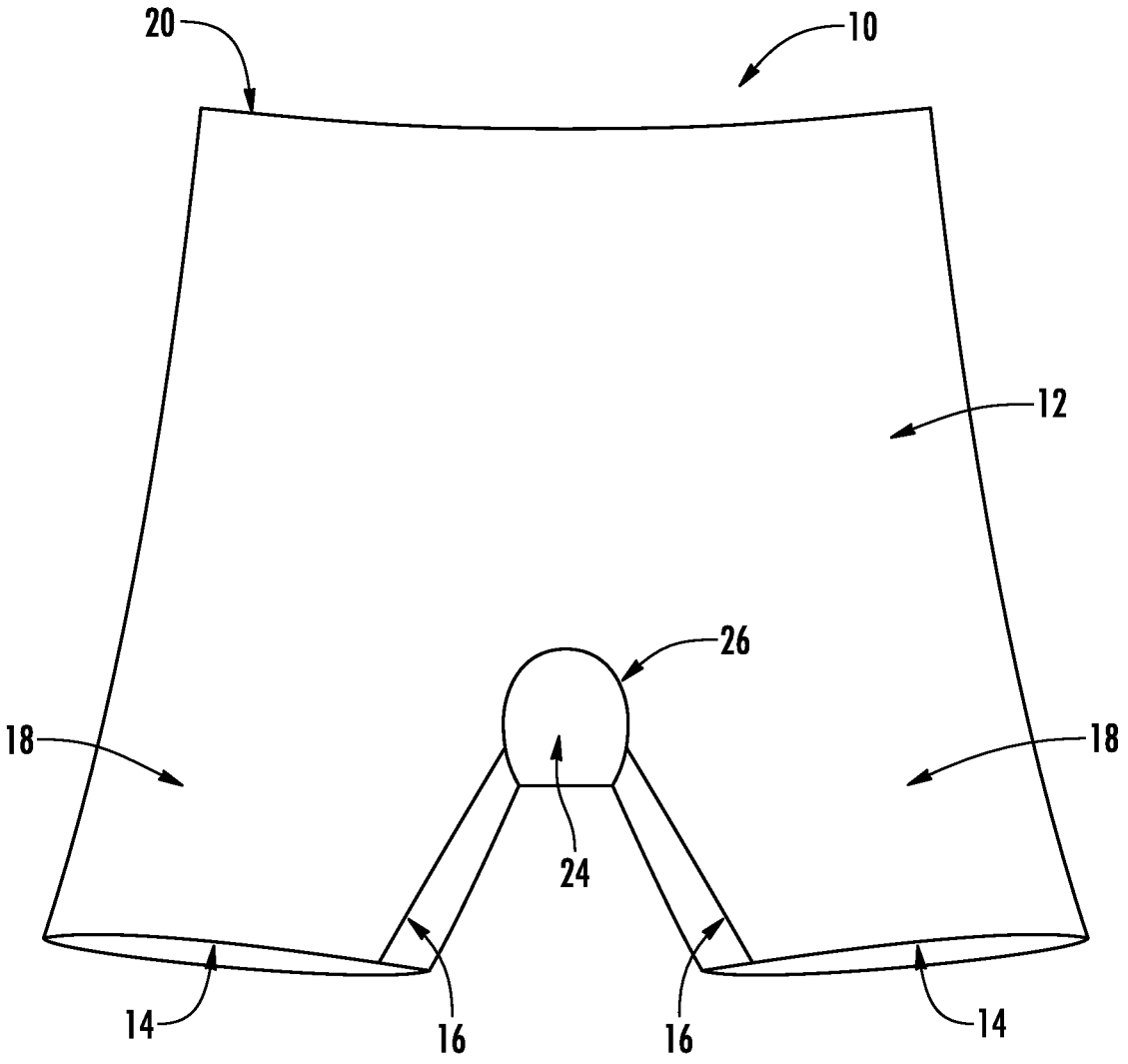
FIG. 1 is an outer front view of an embodiment of the garment.
Figure 2:
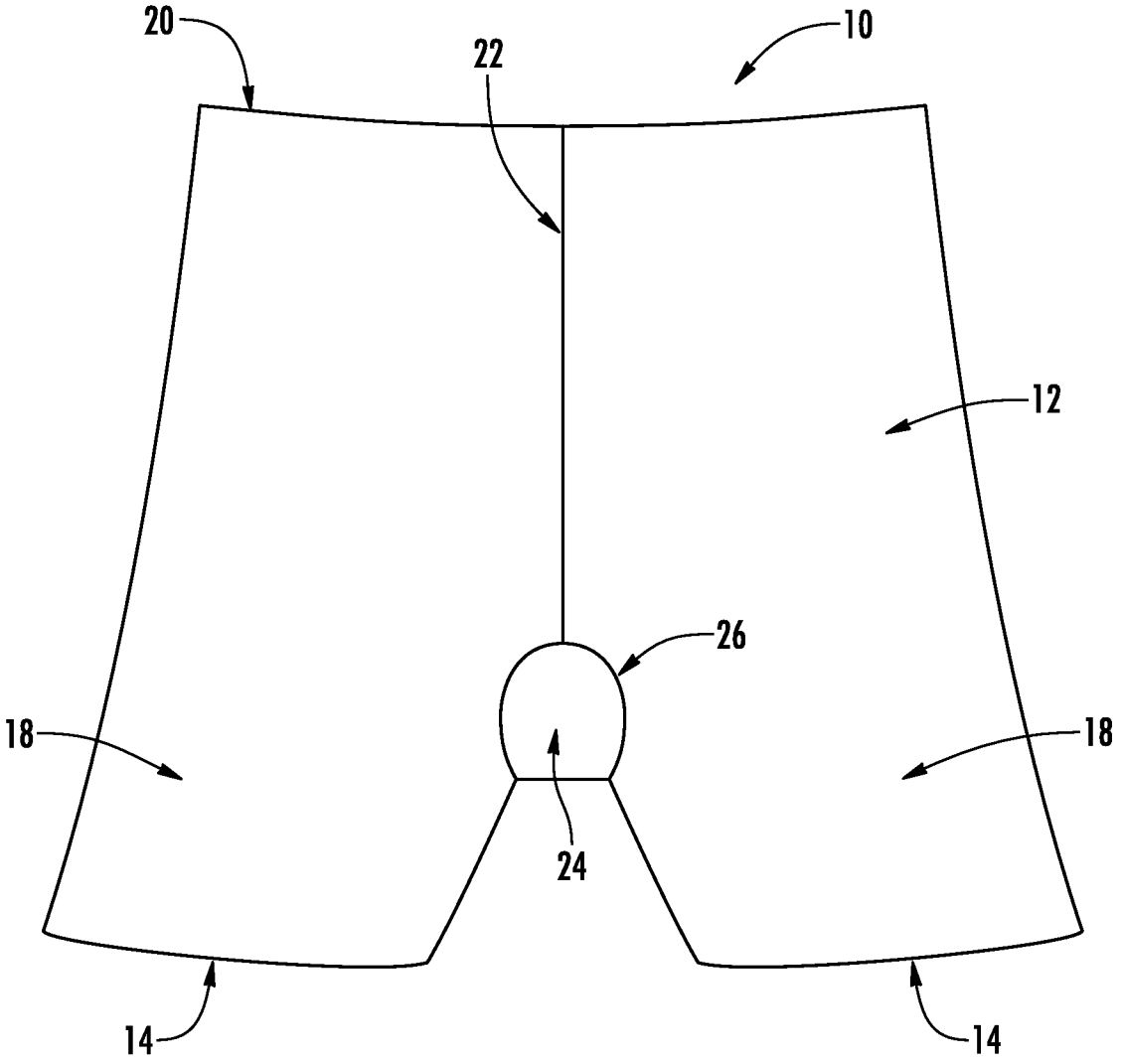
FIG. 2 is an outer back view of an embodiment of the garment.

FIG. 1 illustrates an exterior view of the front of an embodiment of a buttocks-enhancing garment. FIG. 2 illustrates an exterior view of the back of an embodiment of a buttocks-enhancing garment 10. The disclosed buttocks-enhancing garment includes an outer garment layer 12 that is visible from the exterior of the garment. The outer garment layer 12 is configured to cover at least the wearer's buttocks and lower abdomen area. The outer garment layer 12 acts as a concealing layer, providing a smooth appearance and hiding the inner construction of the garment.

In certain embodiments, the outer garment layer is made from one or more of elastane, polyester, nylon, regenerative fibers, polypropylene, or acrylic. In some embodiments, the outer garment layer can be made from elastane and a second fiber. The second fiber can include one or more of polyester, nylon, regenerative fibers, polypropylene, or acrylic. In certain embodiments, the outer garment layer comprises between 5% and 70% elastane and between 30% and 95% of a second fiber.

FIGS. 1 and 2 illustrate one embodiment of the garment 10 and is not intended to be limiting. In certain embodiments, the garment may include panties, shorties, boyshorts, bodysuits, slips, shapesuits, rompers, leggings, tunics, or a similar garment. In certain embodiments, the garment includes a left leg portion and a right leg portion. In certain embodiments, the left leg portion and right leg portion are midthigh length. In certain embodiments, the left leg portion and right leg portion are longer than midthigh length. In certain embodiments, the garment includes a portion configured to cover at least part of the upper body of the wearer.

In certain embodiments, the garment 10 includes a right and left leg opening 14. In certain embodiments, the outer garment layer 12 includes right and left leg seams 16 extending from a crotch area of the garment to the right and left leg openings 14. FIG. 1 illustrates a garment 10 having right and left leg portions 18 and right and left leg seams 16 extending from a crotch area of the garment along the right and left leg portions 18 to the right and left leg openings 14. The right and left leg seams 16 can be completely enfolded within the garment layer such that they do not contact the wearer. In certain embodiments, the garment 10 includes an upper edge 20. The upper edge 20 of the garment can define an opening for encircling the wearer's body. In certain embodiments, the outer garment layer 12 includes an outer garment seam 22 that extends down the center of the buttocks area from an upper edge 20 of the garment to a crotch area of the garment, as shown in FIG. 2.

In certain embodiments, the garment includes a crotch panel 24 in the crotch area of the garment. FIGS. 1 and 2 show a crotch panel 24 attached to the outer garment layer 12. In certain embodiments, crotch panel 24 is attached to outer garment layer 12 by a seam, bonding, or other attachment methods. In certain embodiments, crotch panel 24 is attached to outer garment layer 12 by a crotch seam 26.

Figure 3:
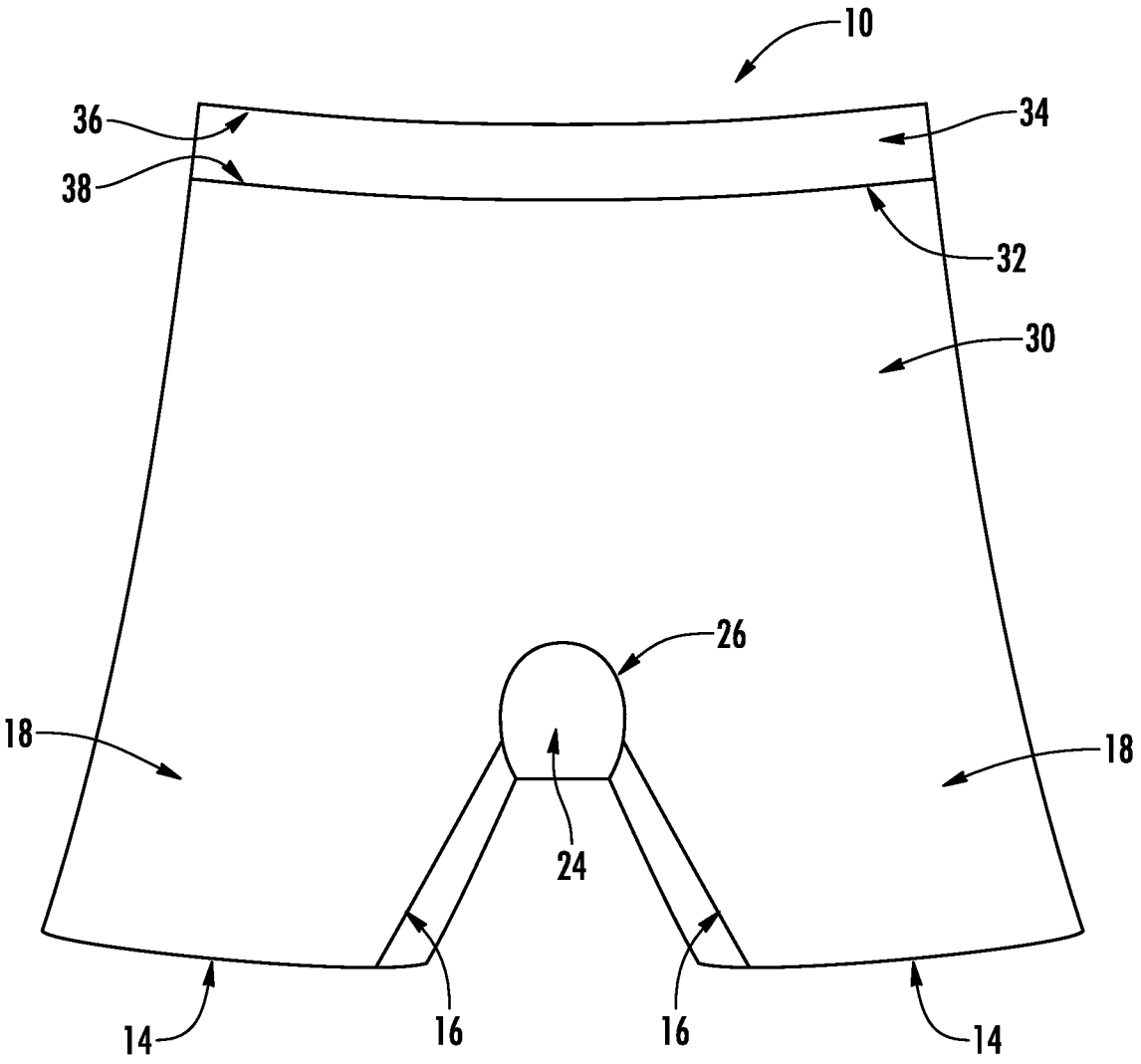
FIG. 3 is an inner front view of an embodiment of the garment.
Figure 4:
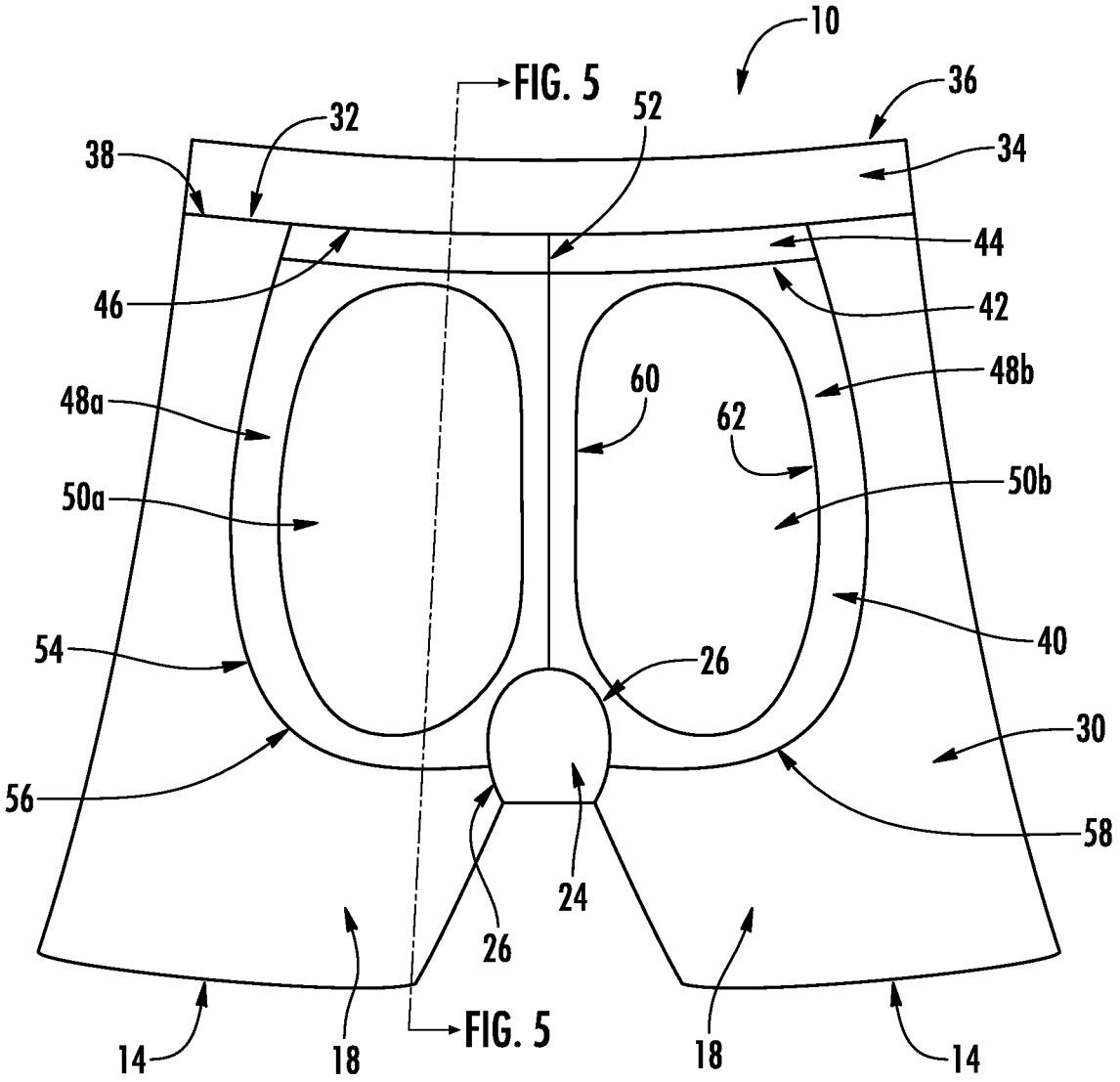
FIG. 4 is an inner back view of an embodiment of the garment.

FIG. 3 illustrates an inner view of the front an embodiment of a buttocks-enhancing shapewear garment 10. FIG. 4 illustrates an inner view of the back of an embodiment of a buttocks-enhancing shapewear garment 10. The garment 10 includes an inner garment layer 30. The inner garment layer 30 is configured to cover at least the wearer's lower abdomen area. In certain embodiments, the inner garment layer 30 defines a right and left leg opening 14. In certain embodiments, the inner garment layer 30 has an upper edge 32. In certain embodiments, the inner garment layer 30 includes right and left leg seams 16 extending from a crotch area of the garment to the lower leg openings 14, as shown in FIG. 3.

In certain embodiments, the inner garment layer 30 is made from the same material as outer garment layer 12. In certain embodiments, the inner garment layer is made from one or more of elastane, polyester, nylon, regenerative fibers, polypropylene, or acrylic. The inner garment layer can be made from elastane and a second fiber. The second fiber can include one or more of polyester, nylon, regenerative fibers, polypropylene, or acrylic. In certain embodiments, the inner garment layer comprises between 5% and 70% elastane and between 30% and 95% of a second fiber.

In certain embodiments, the inner garment layer 30 and the outer garment layer 12 are formed from different pieces of fabric and attached by sewing, bonding, or other methods. In other embodiments, the inner garment layer 30 and the outer garment layer 12 are formed continuously from the same piece of fabric. The piece of fabric is folded, creating a fold line along the leg opening 14 of the garment and separating the piece of fabric into the inner garment layer 30 and the outer garment layer 12. The inner garment layer 30 and the outer garment layer 12 are connected at the fold along the right and left leg openings 14. In certain embodiments, the inner garment layer 30 and the outer garment layer 12 have a seamless construction.

Figure 5:
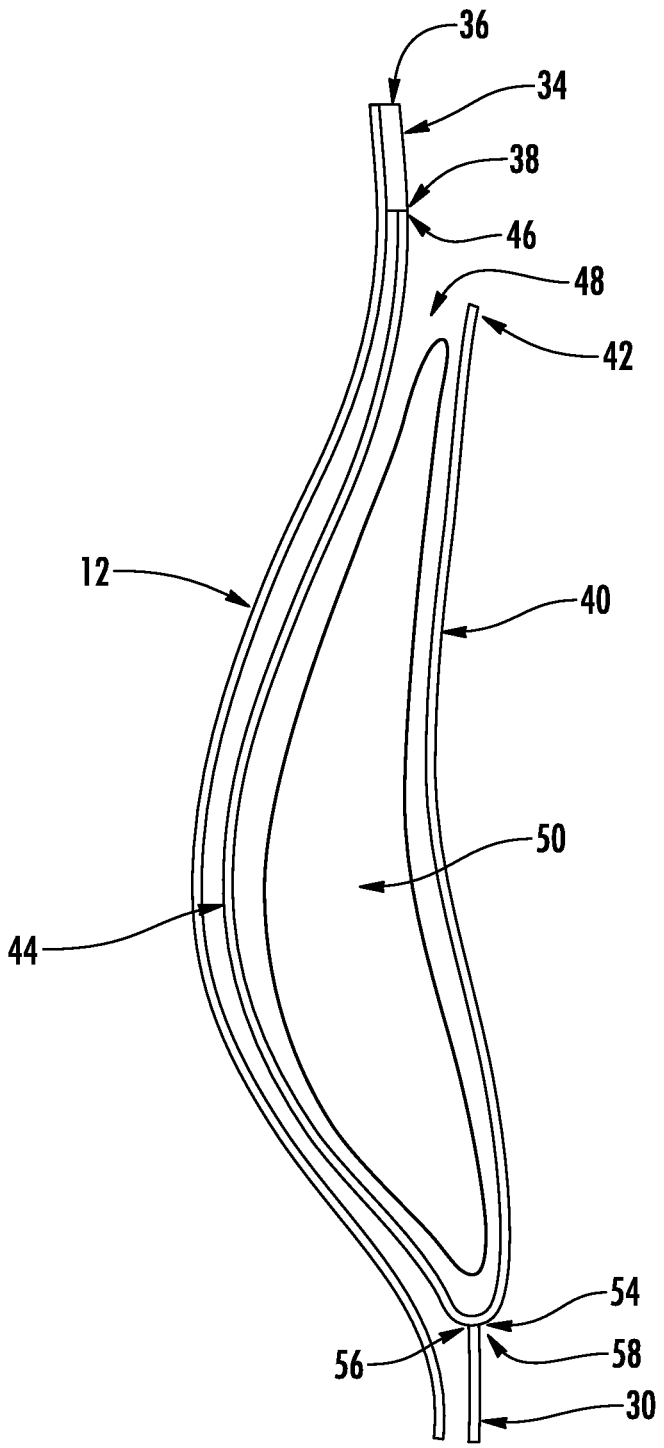
FIG. 5 is a cross-sectional view of a back portion of the garment.

In certain embodiments, the garment includes a waistband 34. FIGS. 3 and 4 show a garment 10 having a waistband 34 visible from the interior view of the garment. The waistband 34 has an upper waistband edge 36 and a lower waistband edge 38. In certain embodiments, the waistband 34 is a "hidden" waistband, which means that it is not visible from the outside of the garment. This provides the garment with a smooth appearance when worn on the body. In certain embodiments, the outer garment layer 12 covers the waistband 34, as shown in the cross-sectional view of FIG. 5. FIG. 5 is a cross-sectional view of the rear of the garment, as shown in FIG. 4, including the waistband 34, outer garment layer 12, outer pocket layer 44, buttock pad 50, inner pocket layer 40, and inner garment layer 30. In certain embodiments, the outer garment layer 12 is attached to the upper waistband edge 36 and extends over an outer surface of the waistband 34. In certain embodiments, the inner garment layer 30 is attached to the lower waistband edge 38 at the upper edge 32 of the inner garment layer.

The garment 10 includes an inner pocket layer 40 and an outer pocket layer 44. The outer pocket layer 44 is positioned between the inner pocket layer 40 and the outer garment layer 12. The inner garment layer does not extend under the outer pocket layer, but instead ends at an inner garment edge 56. In certain embodiments, the outer pocket layer 44 is attached to the waistband 34 at a top outer pocket edge 46. In certain embodiments, the outer pocket layer 44 is attached to the lower waistband edge 38. In certain embodiments, the inner pocket layer 40 is not attached to the waistband 34. In certain embodiments, a portion of the inner pocket layer 40 is attached to the waistband 34. FIG. 5 illustrates a cross-sectional view of the garment, including the outer garment layer 12, the outer pocket layer 44, and the inner pocket layer 40. In the embodiment shown in FIG. 5, the outer garment layer 12 is attached to the upper waistband edge 36 and extends over an outer surface of the waistband 34, and the outer pocket layer 44 is attached to a lower waistband edge 38. The outer pocket layer 44 and a top inner pocket edge 42 of the inner pocket layer 40 define a pocket 48. The pocket 48 is configured to hold a buttock pad 50. The buttock pad 50 is received in the pocket 48 through an upper pocket opening defined by the outer pocket layer 44 and the top inner pocket edge 42.

In certain embodiments, the inner pocket layer 40 includes one or more of elastane, polyester, nylon, regenerative fibers, polypropylene, cotton, and acrylic. The inner pocket layer can be made, for example, from elastane and a second fiber. The second fiber can include one or more of polyester, nylon, regenerative fibers, polypropylene, or acrylic. In certain embodiments, the inner pocket layer comprises between 5% and 70% elastane and between 30% and 95% of a second fiber. In certain embodiments, the outer pocket layer 44 is made from the same material as inner pocket layer 40.

In certain embodiments, the outer pocket layer 40 includes one or more of elastane, polyester, nylon, regenerative fibers, polypropylene, cotton, and acrylic. The outer pocket layer can be made, for example, from elastane and a second fiber. The second fiber can include one or more of polyester, nylon, regenerative fibers, polypropylene, or acrylic. In certain embodiments, the outer pocket layer comprises between 5% and 70% elastane and between 30% and 95% of a second fiber.

In certain embodiments, the inner pocket layer 40 and the outer pocket layer 44 comprise a different material than either of the outer garment layer 12 and inner garment layer 30. In certain embodiments, either or both of the inner pocket layer 40 and the outer pocket layer 44 include a mesh material. This allows the portion of the garment covering the buttocks area to be lightweight and breathable. The mesh material can have a lower amount of stretch or compression than the material used for the inner garment layer. This provides a natural shape to the buttocks without unnecessary compression.

In certain embodiments, a center seam 52 extends inferiorly from the waistband 34 through the outer pocket layer 44 and inner pocket layer 40, separating the outer pocket layer 44 and inner pocket layer 40 into a right pocket 48*a* and left pocket 48*b*, as shown in FIG. 4. In certain embodiments, the right pocket 48*a* is configured to hold a right buttock pad 50*a* and the left pocket 48*b* is configured to hold a left buttock pad 50*b*. In certain embodiments, the center seam 52 is gathered. This allows the garment to contour to the wearer's body. In certain embodiments, the center seam 52 contacts the wearer's body.

In certain embodiments, the outer pocket layer 44 and inner pocket layer 40 are attached to the inner garment layer 30 at a pocket perimeter edge 54. In certain embodiments, the outer pocket layer 44 and inner pocket layer 40 are configured to cover the buttocks. In certain embodiments, the inner garment layer 30 does not cover the wearer's buttocks. In these embodiments, the inner garment layer 30 has an inner garment edge 56. The inner garment layer 30 is attached to the pocket perimeter edge 54 along the inner garment edge 56. The outer pocket layer 44 is directly adjacent the outer garment layer 12 and the inner garment layer 30. This allows the pocket construction and the buttock pads to shape and enhance the appearance of the wearer's buttocks without adding additional layers to the construction over the wearer's buttocks. Additionally, the material used for the outer pocket layer 44 and inner pocket layer 40 can have less compression than the material used for the inner garment layer 30 and outer garment layer 12, providing shaping and lift to the buttocks without additional compression or flattening of the body.

FIG. 4 shows a garment having a pocket perimeter edge 54, an inner garment edge 56, and a U-shaped perimeter seam 58 connecting the inner garment layer 30 to the outer pocket layer 44 and inner pocket layer 40. In certain embodiments, either or both of the outer pocket layer 44 and inner pocket layer 40 are attached to the inner garment layer 30 by a perimeter seam 58. In certain embodiments, the perimeter seam 58 is a U-shaped seam that extends inferiorly from the waistband and curves under the buttocks. The U-shaped seam allows the garment to contour to the wearer's shape.

In certain embodiments, the garment includes a crotch panel 24 in the crotch area of the garment attached to one or more of the inner garment layer 30, the outer pocket layer 44, and the inner pocket layer 40, as shown in FIGS. 3 and 4. In certain embodiments, crotch panel 24 is attached to one or more of the inner garment layer 30, outer pocket layer 44, and inner pocket layer 40 by a seam, bonding, or other attachment methods. In certain embodiments, crotch panel 24 is attached to one or more of the inner garment layer 30, outer pocket layer 44, and inner pocket layer 40 by a crotch seam 26. In certain embodiments, the crotch panel 24 is one layer of fabric. In certain embodiments, the crotch panel 24 includes more than one layer of fabric. In certain embodiments, the crotch panel 24 comprises cotton. In certain embodiments, the crotch panel 24 includes the same material as either or both of outer garment layer 12 and inner garment layer 30.

Figure 6:
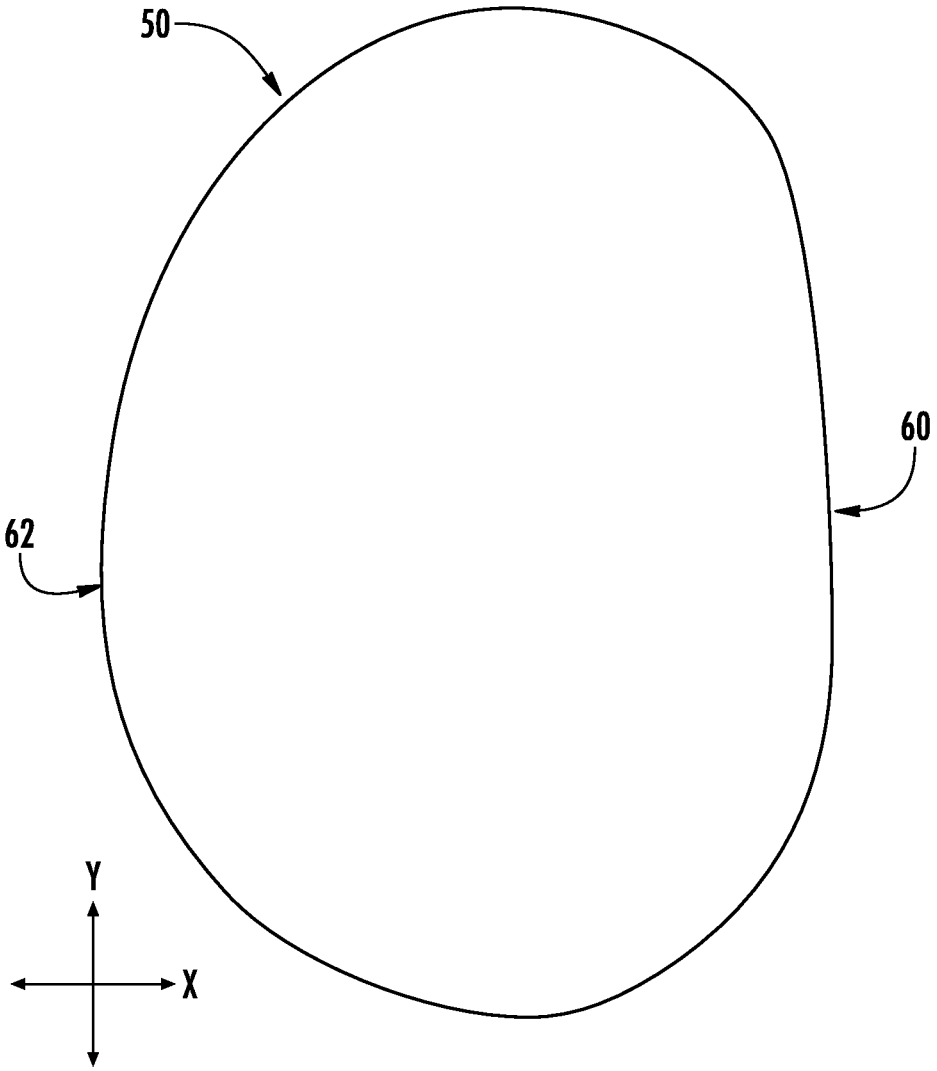
FIG. 6 is a view of an embodiment of a pad for the garment.

The pockets 48 of the garment 10 are configured to hold buttock pads 50. In certain embodiments, a right pocket 48*a* is configured to hold a right buttock pad 50*a* and a left pocket 48*b* is configured to hold a left buttock pad 50*b*. The buttock pads 50 provide shaping and lift to the wearer's buttocks, and can be any shape that will provide a desirable appearance to the wearer's buttocks. In certain embodiments, the right and left buttock pads 50*a* and 50*b* are mirror images of each other. In certain embodiments, each buttock pad 50 is oval-shaped, having two longer sides and two shorter sides. Each oval-shaped buttock pad 50 can be symmetrical on both the x- and y-axes, or it can be symmetrical on one axis, or it can exhibit no symmetry. The x- and y-axes are shown in FIG. 6. In certain embodiments, one of the longer sides of each oval-shaped buttock pad is a less curved side 60, and the other longer side is a more curved side 62, as shown in FIG. 6. In certain embodiments, the buttock pads 50 are positioned within the pockets 48 such that the central, less curved side 60 of each buttock pad 50 is adjacent the center seam 52. FIG. 4 illustrates a garment 10 having a right pocket 48*a* and left pocket 48*b*, in which right buttock pad 50*a* and left buttock pad 50*b* have been positioned. In FIG. 4, the right and left buttock pads 50*a* and 50*b* each have a less-curved side 60, and the buttock pads 50*a* and 50*b* are positioned within the pockets 48*a* and 48*b* such that each less-curved side 60 is adjacent the center seam 52. In certain embodiments, in a first configuration, the right buttock pad 50*a* and the left buttock pad 50*b* are removed from the garment, and in a second configuration, the right buttock pad 50*a* and the left buttock pad 50*b* are positioned within the right pocket 48*a* and left pocket 48*b* such that a central, less curved side 60 is adjacent the center seam 52.

In certain embodiments, the buttock pads 50 comprise foam. The buttock pads can include one or more of polyurethane foam, fiber fill, silicone foam or silicone gel, polyurethane gel, styrene block copolymer (such as, for example, Kraton), or a bladder filled with oil, air, powder, or fiber fill. The fiber fill can include one or more of polyester, nylon, regenerative fibers, polypropylene, or acrylic fibers. In certain embodiments, the buttock pads are laminated with a fabric. The fabric can include one or more of polyester, nylon, regenerative fiber, polypropylene, acrylic, or cotton.

It is desirable for the buttock pads 50 to not be visible from the exterior of the garment or when the garment is worn under clothing. Therefore, in certain embodiments, the buttock pads 50 are thinner at the edges and thicker towards the center. In certain embodiments, the buttock pads 50 have a greatest thickness at a center point of the buttock pads. In certain embodiments, the buttock pads 50 have a greatest thickness at a point that is not in the center point of the buttock pad. For example, the buttock pads 50 can have a greatest thickness at a point that is above the center point of the pad when the pad is positioned in the pocket 48. This provides the appearance of lift to the buttocks of the wearer when the garment is worn.

Also disclosed herein are methods of making a buttocks-enhancing shapewear garment. An outer garment layer and an inner garment layer are cut from a garment fabric. The outer garment layer and the inner garment layer can be cut from the same fabric, or the outer garment layer can be cut from a different fabric than the inner garment layer. In certain embodiments, the outer garment layer and the inner garment layer are cut continuously from the same piece of garment fabric. In certain embodiments, the garment fabric is folded to form a leg opening edge connecting the outer garment layer and the inner garment layer. This folded edge provides a smooth appearance when worn, as there is no seam or additional layers of fabric at the edge of the garment. In certain embodiments, the garment is assembled by sewing an outer garment seam extending inferiorly from the waistband along the back side of the outer garment layer.

An outer pocket layer and an inner pocket layer are cut from a pocket fabric. The outer pocket layer and the inner pocket layer can be cut from the same fabric, or the outer pocket layer can be cut from a different fabric than the inner pocket layer. In certain embodiments, the pocket fabric includes a mesh fabric. In certain embodiments, the pocket fabric has a lower amount of compression than the garment fabric.

A right buttock pad and a left buttock pad are formed. The right and left buttock pads can be formed using one or more of foam, fiber fill, silicone foam or silicone gel, polyurethane gel, styrene block copolymer, or a bladder filled with oil, air, powder, or fiber fill. In some embodiments, forming the right and left buttock pads includes forming an inside layer and then laminating the inside layer. The inside layer can be laminated with fabric. The fabric can include one or more of polyester, nylon, regenerative fiber, polypropylene, acrylic, or cotton.

The outer pocket layer and the inner pocket layer are attached to the inner garment layer at a pocket perimeter edge such that the outer pocket layer is between the inner pocket layer and the outer garment layer. The outer pocket layer and the inner pocket layer can be attached to the inner garment layer by a seam, bonding, or other methods of attachment. In certain embodiments, the inner garment layer comprises an inner garment edge. The outer pocket layer and the inner pocket layer are attached to the inner garment layer along the inner garment edge, such that the outer pocket layer is directly adjacent the outer garment layer.

A waistband is provided, having an upper edge and a lower edge. The outer garment layer, inner garment layer, and outer pocket layer are attached to the waistband. A center seam is sewn, extending inferiorly from the waistband through the outer pocket layer and the inner pocket layer. The center seam separates the outer pocket layer and the inner pocket layer into a right pocket and a left pocket. In certain embodiments, the center seam is gathered. The right buttock pad can be placed into the right pocket, and the left buttock pad can be placed into the left pocket.

In certain embodiments, a crotch panel is provided. The crotch panel can comprise one or more layers of fabric. In certain embodiments, the crotch panel is attached to the outer garment layer, the inner garment layer, the outer pocket layer, and the inner pocket layer. In certain embodiments, the crotch panel comprises more than one layer, and each layer is attached to one or more of the outer garment layer, the inner garment layer, the outer pocket layer, and the inner pocket layer.

The invention claimed is:

1. A buttocks-enhancing shapewear garment comprising:

an outer garment layer, an inner garment layer, an outer pocket layer, an inner pocket layer, a right buttock pad, a left buttock pad, an elongated crotch panel, and a waistband;

wherein the outer pocket layer and the inner pocket layer are configured to cover a buttocks area of the wearer;

wherein the outer pocket layer and the inner pocket layer are attached to the inner garment layer at a pocket perimeter edge such that the outer pocket layer is between the inner pocket layer and the outer garment layer;

wherein the outer pocket layer is attached to the waistband at a top outer pocket edge;

wherein the outer pocket layer and a top inner pocket edge of the inner pocket layer define an upper pocket opening;

wherein a center seam extends inferiorly from the waistband through the outer pocket layer and the inner pocket layer, the center seam separating the outer pocket layer and the inner pocket layer into a right pocket and a left pocket, the right pocket configured to hold the right buttock pad and the left pocket configured to hold the left buttock pad; and wherein a crotch seam that extends around the elongated crotch panel attaches an edge portion of the elongated crotch panel to an edge portion of the right pocket, an edge portion of the left pocket, an edge portion of the outer garment layer, and an edge portion of the inner garment layer;

wherein the outer garment layer at least partially covers the outer pocket layer, thereby compressing the outer pocket layer.

2. The buttocks-enhancing shapewear garment of claim 1, wherein the outer pocket layer and the inner pocket layer have less compression than a material of the outer garment layer.

3. The buttocks-enhancing shapewear garment of claim 1, wherein at least one of the inner pocket layer and the outer pocket layer is mesh.

4. The buttocks-enhancing shapewear garment of claim 1, wherein the waistband is attached to the outer garment layer, the inner garment layer, and the outer pocket layer, and is not visible from an exterior surface of the garment.

5. The buttocks-enhancing shapewear garment of claim 4, wherein the outer garment layer is configured to cover the waistband.

6. The buttocks-enhancing garment of claim 5, wherein the waistband has an upper edge and a lower edge, and wherein the outer garment layer extends over an outer surface of the waistband and is attached to the upper edge of the waistband.

7. The buttocks-enhancing garment of claim 6, wherein the inner garment layer and the outer pocket layer are attached to the lower edge of the waistband.

8. The buttocks-enhancing shapewear garment of claim 4, wherein the inner pocket layer is not attached to the waistband.

9. The buttocks-enhancing shapewear garment of claim 1, wherein the center seam extending inferiorly from the waistband is gathered.

10. The buttocks-enhancing shapewear garment of claim 1, wherein the outer garment layer and the inner garment layer are formed continuously from a same piece of fabric.

11. The buttocks-enhancing shapewear garment of claim 10, wherein the outer garment layer and inner garment layer define a right leg opening and a left leg opening, and wherein the outer garment layer and inner garment layer are connected at a fold along the right and left leg openings.

12. The buttocks-enhancing shapewear garment of claim 10, wherein the outer garment layer comprises an outer garment seam extending inferiorly from the waistband along a back side of the outer garment layer.

13. The buttocks-enhancing shapewear garment of claim 1, wherein the inner garment layer further comprises an inner garment edge along the pocket perimeter edge, and wherein the outer pocket layer is directly adjacent the outer garment layer.

14. The buttocks-enhancing shapewear garment of claim 1, wherein the inner pocket layer and the outer pocket layer are attached to the inner garment layer by a perimeter seam.

15. The buttocks-enhancing shapewear garment of claim 14, wherein the perimeter seam is a u-shaped seam that extends inferiorly from the waistband and is configured to curve under the buttocks of the wearer.

16. The buttocks-enhancing shapewear garment of claim 1, further comprising a crotch area, a right leg portion, and a left leg portion, wherein the right leg portion and left leg portion extend inferiorly from the crotch area.

17. The buttocks-enhancing shapewear garment of claim 1, wherein the right and left pads are oval-shaped, having two longer sides and two shorter sides.

18. The buttocks-enhancing shapewear garment of claim 17, where one of the longer sides of each pad is a less curved side, and the pads are placed in the pocket so that the less curved side is adjacent the center seam.

19. The buttocks-enhancing shapewear garment of claim 17, wherein the pads are thinner at edges than at a center.

20. The buttocks-enhancing shapewear garment of claim 1, wherein in a first configuration, the right buttock pad and the left buttock pad are removed from the garment, and wherein in a second configuration, the right buttock pad and the left buttock pad are positioned within the right and left pockets such that a central, less curved side is adjacent the center seam.

* * * * *